US011364617B2

(12) United States Patent
Wang

(10) Patent No.: US 11,364,617 B2
(45) Date of Patent: Jun. 21, 2022

(54) MOVABLE WORKTABLE

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Weiyi Wang, Hangzhou (CN)

(73) Assignees: Hangzhou United Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 557 days.

(21) Appl. No.: 16/346,515

(22) PCT Filed: Jun. 27, 2018

(86) PCT No.: PCT/CN2018/093025
§ 371 (c)(1),
(2) Date: Apr. 30, 2019

(87) PCT Pub. No.: WO2020/000235
PCT Pub. Date: Jan. 2, 2020

(65) Prior Publication Data

US 2021/0362319 A1 Nov. 25, 2021

(51) Int. Cl.
*B25H 1/04* (2006.01)
*B25H 1/12* (2006.01)

(52) U.S. Cl.
CPC ..... *B25H 1/04* (2013.01); *B25H 1/12* (2013.01)

(58) Field of Classification Search
CPC ... B25H 1/04; B25H 1/12; B25H 1/02; B25H 1/18; A47B 5/04; A47B 5/06; A47B 2003/0835; A47B 13/081; A47B 1/10
USPC ..... 108/161, 13
See application file for complete search history.

(56) References Cited

U.S. PATENT DOCUMENTS

| | | | | |
|---|---|---|---|---|
| 2,833,609 | A * | 5/1958 | Lawless | A47B 13/081 108/62 |
| 5,642,898 | A | 7/1997 | Wise | |
| 6,948,539 | B1 | 9/2005 | Barker et al. | |
| 8,944,444 | B1 * | 2/2015 | Tvrdy | B62B 3/10 280/79.2 |
| 9,527,205 | B1 * | 12/2016 | Lin | B25H 1/12 |
| 2005/0140106 | A1 * | 6/2005 | Huguet | A47B 95/043 280/79.3 |

(Continued)

FOREIGN PATENT DOCUMENTS

| | | | |
|---|---|---|---|
| CN | 202964608 | U | 6/2013 |
| CN | 206614499 | U | 11/2017 |

(Continued)

OTHER PUBLICATIONS

International Search Report and Written Opinion dated Mar. 29, 2019 with its English translation from PCT/CN2018/093025.

*Primary Examiner* — Tyrone V Hall, Jr.
(74) *Attorney, Agent, or Firm* — Blank Rome LLP

(57) ABSTRACT

The present invention discloses a movable worktable, comprising wheels, a support provided on the wheels and a table top provided on the support, wherein the table top may be opened and turned over, a first closed storage space is provided below the table top and an open storage space is provided below the first closed storage space. The present invention provides a worktable which can store various tools and is convenient to move.

8 Claims, 6 Drawing Sheets

(56) References Cited

U.S. PATENT DOCUMENTS

| | | | | |
|---|---|---|---|---|
| 2009/0309381 | A1* | 12/2009 | Nelson | B62D 33/0273 296/26.11 |
| 2010/0026151 | A1* | 2/2010 | Melkumyan | B62B 3/004 312/249.11 |
| 2010/0072716 | A1* | 3/2010 | Grela | B25H 3/021 280/47.35 |
| 2013/0087982 | A1* | 4/2013 | Grela | B25H 3/028 280/79.2 |
| 2015/0115786 | A1* | 4/2015 | Manalang | B25H 3/028 312/321.5 |
| 2015/0210306 | A1* | 7/2015 | Oachs | B25H 5/00 280/79.11 |
| 2016/0058171 | A1* | 3/2016 | Moyer | B23Q 3/18 312/281 |

FOREIGN PATENT DOCUMENTS

| | | | |
|---|---|---|---|
| CN | 207189610 | U | 4/2018 |
| CN | 207373113 | U | 5/2018 |
| WO | 9415824 | A1 | 7/1994 |

* cited by examiner

MOVABLE WORKTABLE

CROSS REFERENCE TO RELATED APPLICATIONS

This is a U.S. National Stage Application, filed under 35 U.S.C. 371, of International Patent Application No. PCT/CN2018/093025, filed on Jun. 27, 2018, the disclosure of which is incorporated herein by reference in its entirety.

FIELD OF THE INVENTION

The present invention relates to a table and platform, and in particular to a movable worktable.

DESCRIPTION OF THE PRIOR ART

In real life, a tool is generally stored in a special tool cabinet. Generally, when a tool is used, the required tool is firstly found from a tool cabinet and then is moved to a worktable for placing parts, so as to start work. When there is a need for switching frequently between different tools, people have to either often take and place the tools from and in the tool cabinet, or simultaneously place many tools on a worktable top. However, this will occupy a space on the table top and decrease work efficiency. Therefore, in cases of that many tools need to used simultaneously, people not only hope to have a tidy worktable top, but also hope to find the needed tools as soon as possible.

SUMMARY OF THE INVENTION

In view of the above-mentioned defects in the prior art, a technical problem to be solved by the present invention is to provide a worktable which can store various tools and is convenient to move.

In order to realize the above-mentioned purpose, the present invention provides a movable worktable, comprising wheels, a support provided on the wheels and a table top provided on the support, wherein the table top may be opened and turned over, a first closed storage space is provided below the table top and an open storage space is provided below the first closed storage space.

Further, a second closed storage space is provided below the first closed storage space and above the open storage space. Further, the second closed storage space is a drawer. And further, the drawer is provided with a broached groove.

Further, in another embodiment, a third closed storage space is further provided below the second closed storage space and above the open storage space. Further, the third closed storage space is a drawer. And further, the drawer is provided with a broached groove.

In one embodiment, the wheels are at least two mecanum wheels at the same side.

In another embodiment, the table top is provided with a raised edge.

In another embodiment, one side of the table top is provided with a hinging member and the table top may be upwards opened around the side provided with the hinging member, turned over and hung down from one side of the worktable.

Further, the hinging member is provided with an L-shaped plug pin, an L-shaped plate and a spring, wherein the L-shaped plate is provided with an insertion hole, the spring is disposed over a shaft of the L-shaped plug pin and the L-shaped plug pin is inserted into the L-shaped plate through the insertion hole.

In another embodiment, sliding grooves are provided in the support, and the table top may be slid along the sliding grooves and opened, turned over, and hung down from one side of the worktable.

In one embodiment, the overall height of the movable worktable is smaller than or equal to 48 inches.

Further, the height of the open storage space is greater than or equal to 10 inches.

In another embodiment, the side of the movable worktable is provided with a hanging plate with meshes or storage grooves.

The concept, specific structure and produced technical effect of the present invention will be further described below in combination with the figures, so as to fully understand the purposes, features and effects of the present invention.

DETAILED DESCRIPTION OF THE PREFERRED EMBODIMENTS

The present invention will be further described below in combination with the figures and the embodiments.

Figure 1:
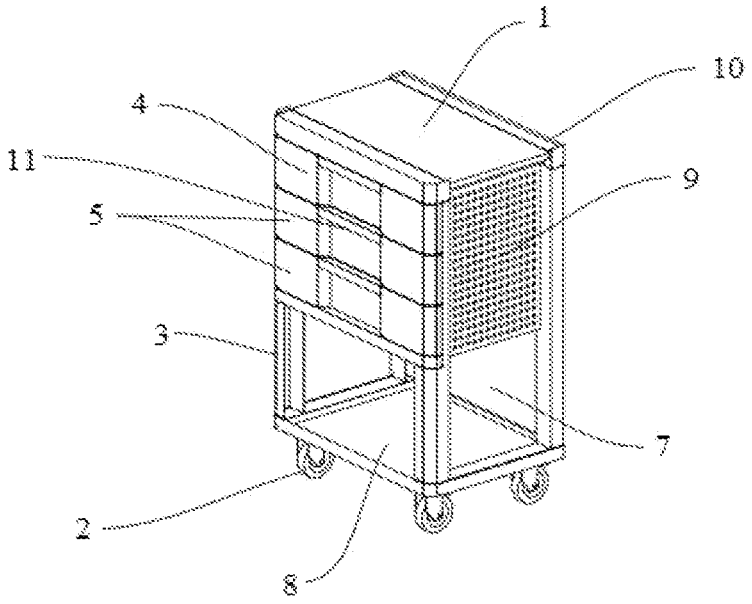
FIG. 1 is a schematic view of a movable worktable according to one embodiment of the present invention.

As illustrated in FIG. 1, a movable worktable according to one particular embodiment of the present invention comprises wheels 2 and a support 3 provided on the wheels 2, and a worktable top 1 provided on the support 3. A closed storage space 4 is provided below the table top 1 (also refer to FIG. 6), an open storage space 7 is further provided between the support 3 and the table top 1, and the open storage space 7 is provided with a bottom plate 8. In this embodiment, two drawers 5 are further provided between the open storage space 7 and the closed storage space 4. In other embodiments, only one drawer or no drawer may be provided.

Figure 2:
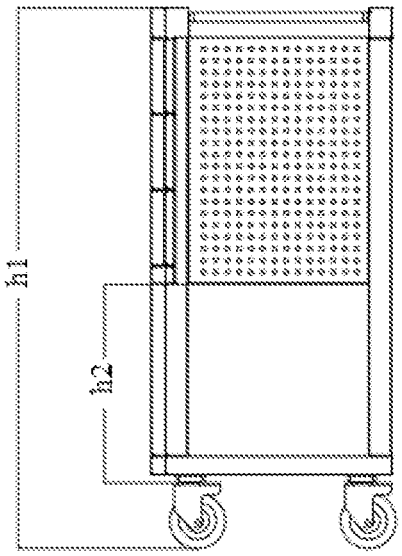
FIG. 2 is a schematic view for a height of a movable worktable according to one embodiment of the present invention.
Figure 4:
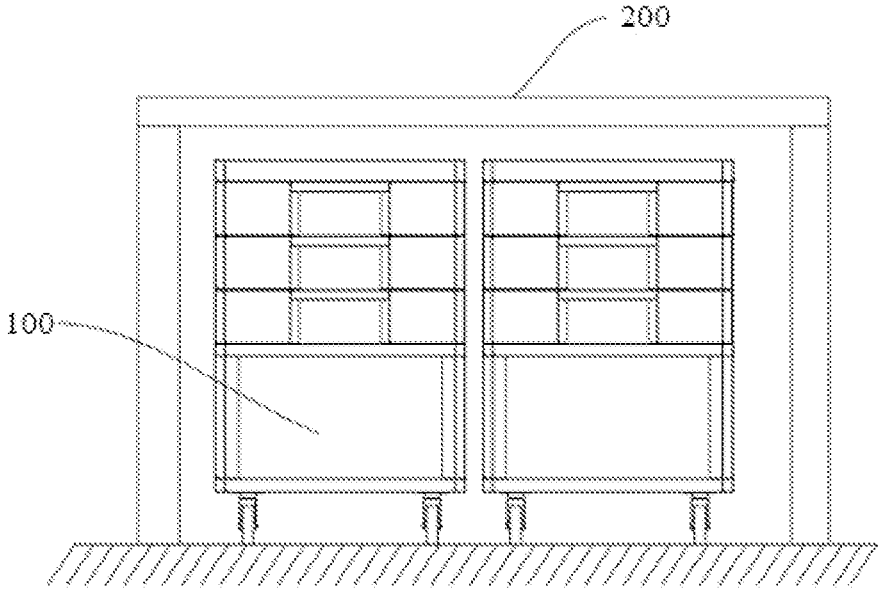
FIG. 4 is a schematic view when two movable worktables are placed below a table according to one embodiment of the present invention.

As illustrated in FIG. 2, in this embodiment, the total height h1 of the movable worktable is smaller than or equal to 48 inches, the height h2 of the open storage space is greater than or equal to 10 inches, such an arrangement can allow the open storage space to store some larger objects, and the total height of the movable worktable 100 allows the worktable to be placed under most of commercially available tables and platforms 200, as illustrated in FIG. 4, thereby facilitating storage and saving space.

Figure 3:
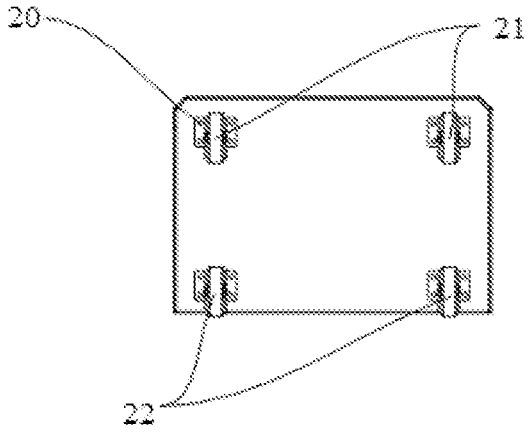
FIG. 3 is a schematic view of wheels according to one embodiment of the present invention.

As illustrated in FIG. 3, in this embodiment, the wheels are at least two mecanum wheels 21 at the same side, the wheels on the other side may be two common wheels 22 and the wheels 20 are fixed to the support through bolts.

Figure 5:
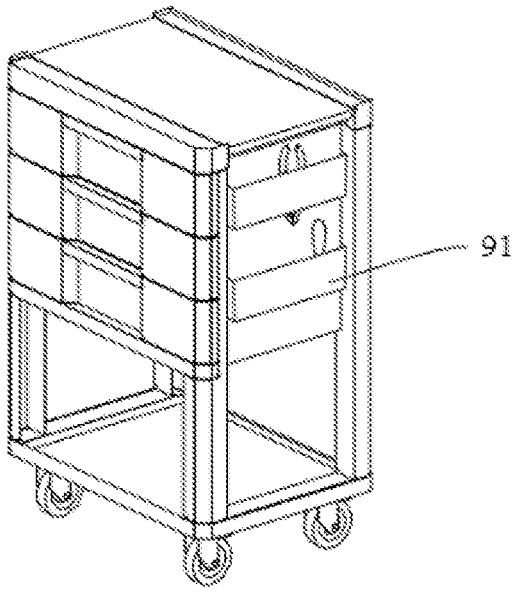
FIG. 5 is a schematic view of a hanging plate at a side of a movable worktable according to one embodiment of the present invention.

In addition, as illustrated in FIG. 1 and FIG. 5, the side of the movable worktable may be provided with a hanging plate with meshes 9 or storage grooves 91 for hanging tools.

Figure 6:
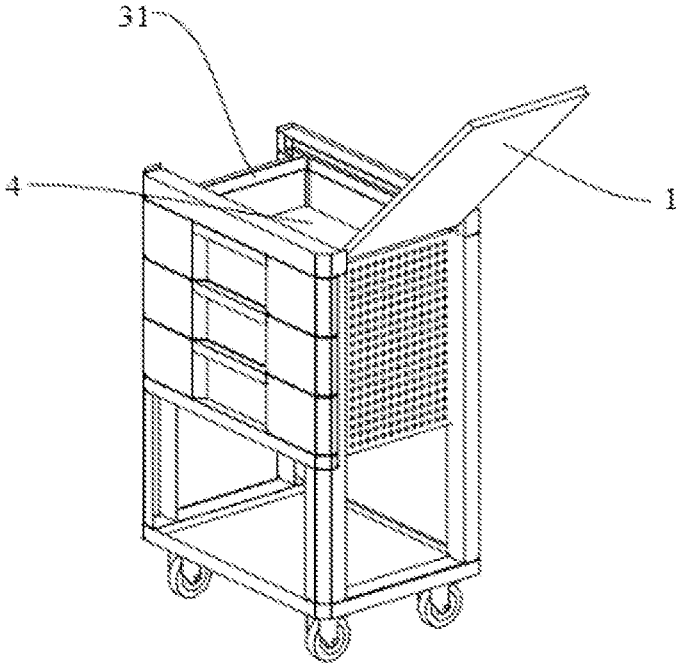
FIG. 6 is a schematic view when a table top is turned over according to one embodiment of the present invention.
Figure 7:
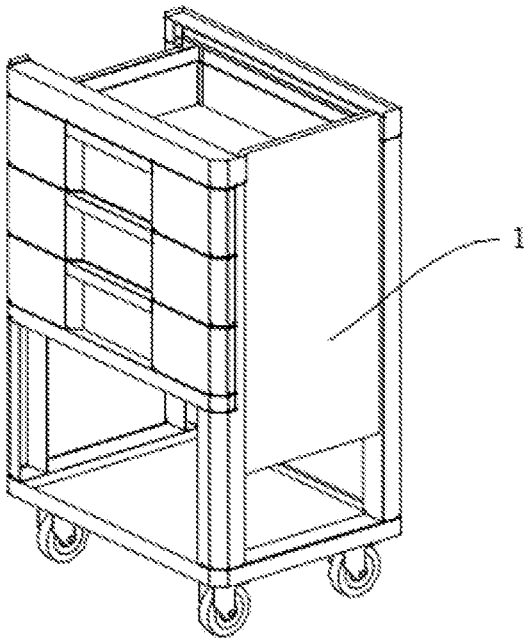
FIG. 7 is a schematic view when a table top is turned over according to one embodiment of the present invention.
Figure 8:
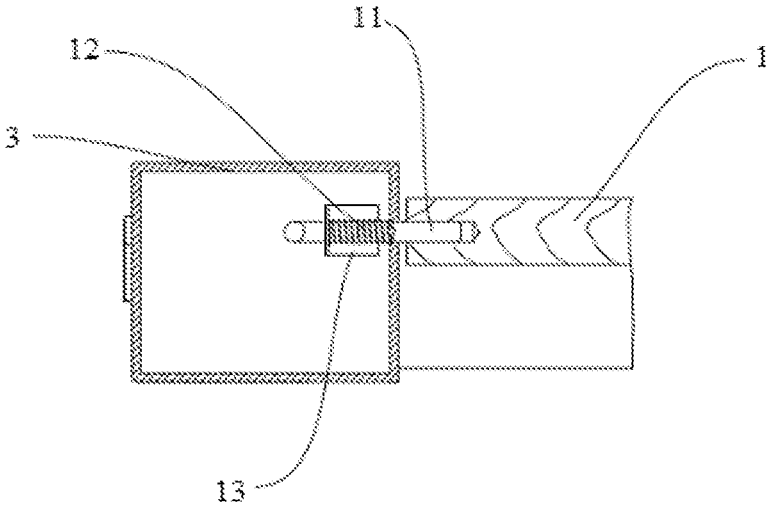
FIG. 8 is a schematic view of a hinging member according to one embodiment of the present invention.
Figure 9:
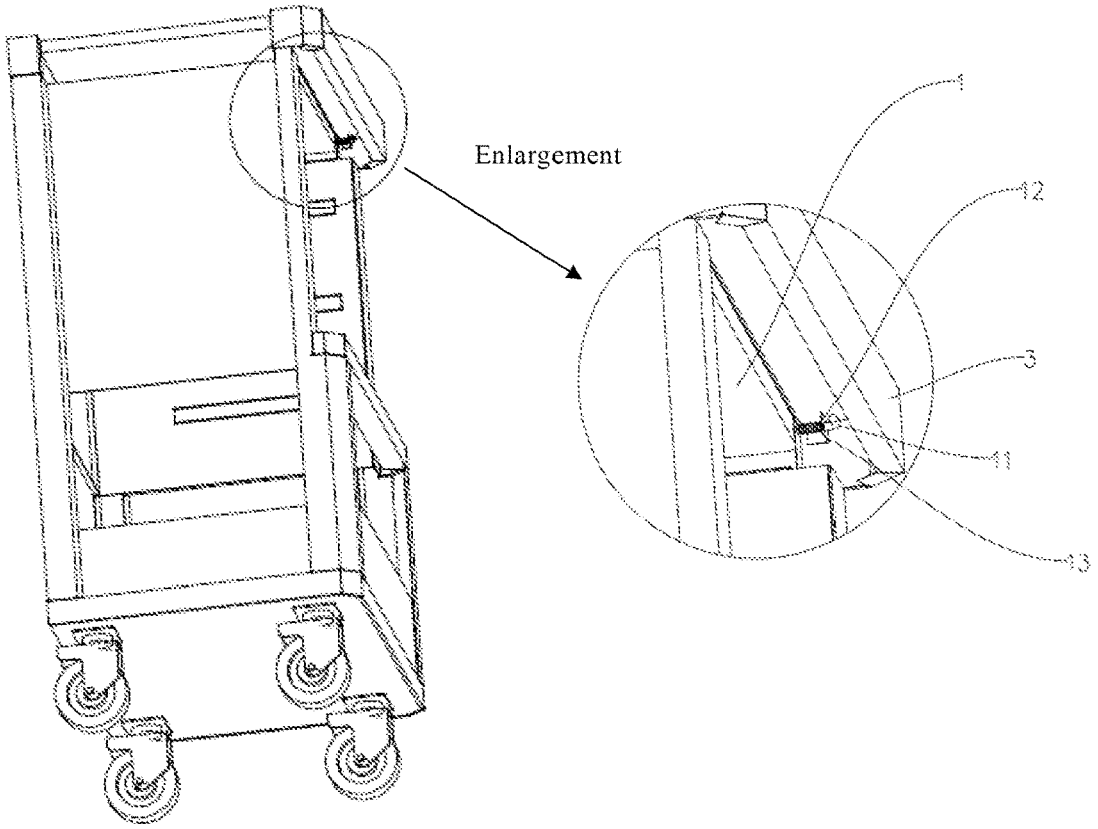
FIG. 9 is a schematic view of a hinging member of a movable worktable according to one embodiment of the present invention.
Figure 11A:
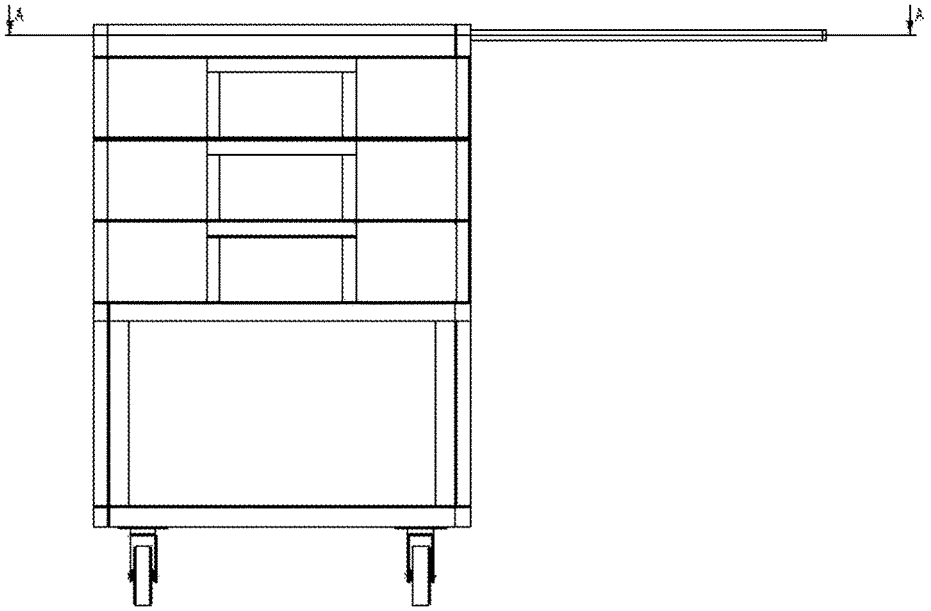
FIG. 11A is a front view of the movable worktable in FIG. 10.
Figure 11B:
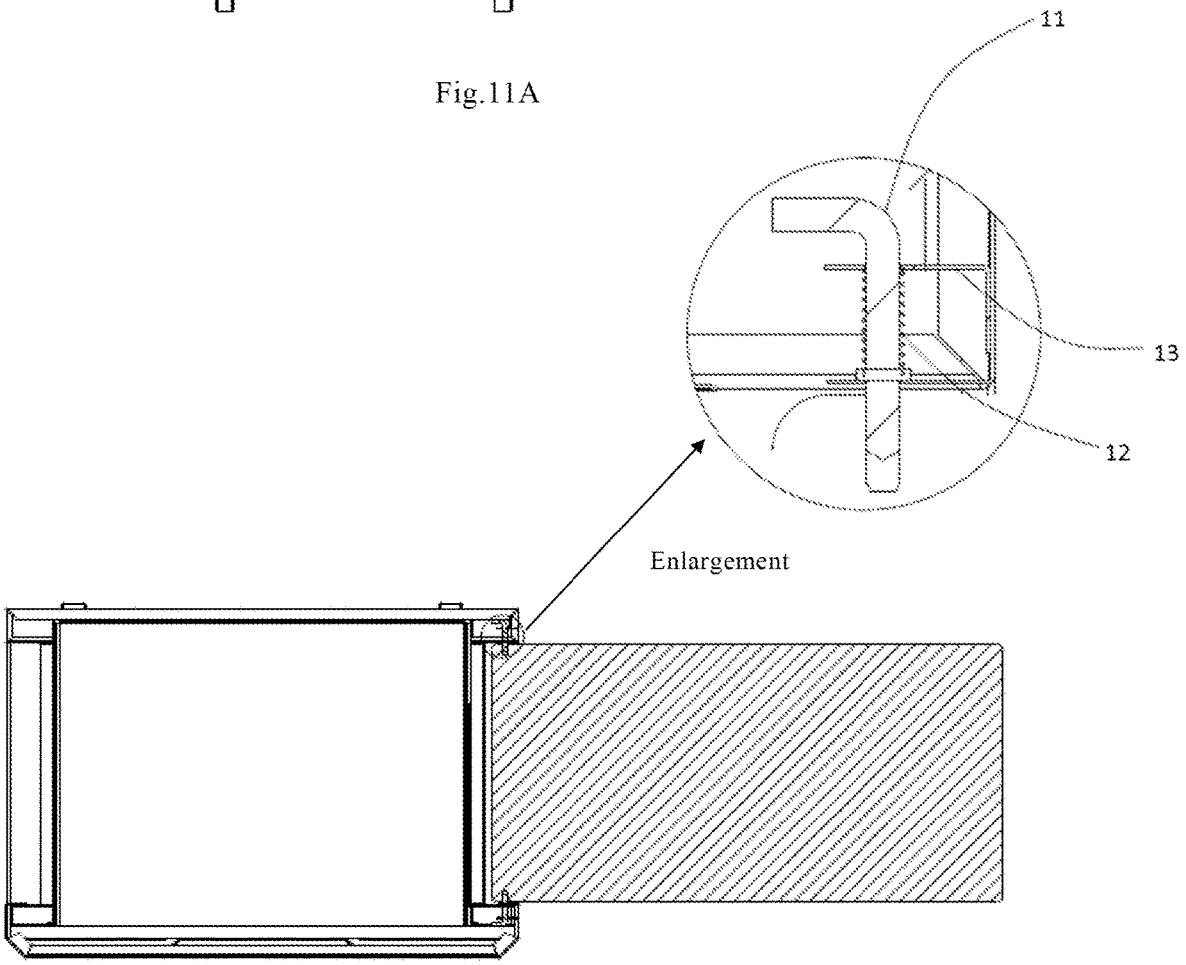
FIG. 11B is a cross-sectional view of A-A in FIG. 11A, which exhibits a structure of a hinging member.

As illustrated in FIG. 6 and FIG. 9, one side of the table top 1 is provided with a hinging member such that the table top 1 may be opened and turned over around the hinging device, and folded and hung down from one side of the worktable, as illustrated in FIG. 7, so as to expose the closed storage space 4. In this way, on one hand, taking and storing tools from and in the closed storage space are facilitated; and on the other hand, as compared with drawers, by using the height of transverse bars 31 for the support, the closed storage space 4 is enabled to be larger. FIG. 8, FIG. 9 and FIG. 11 illustrate a hinging member used in this embodiment, a pin shaft hole is provided in a side of an end of the table top 1, an L-shaped plate 13 is welded onto the support 3, an L-shaped plug pin 11 is inserted through an insertion hole in the L-shaped plate 13, a spring 12 is disposed over a pin shaft, one end of the spring 12 is in contact with the support 3, and the other end is in contact with the L-shaped plate 13, thereby achieving a quick-detach function.

Figure 10:
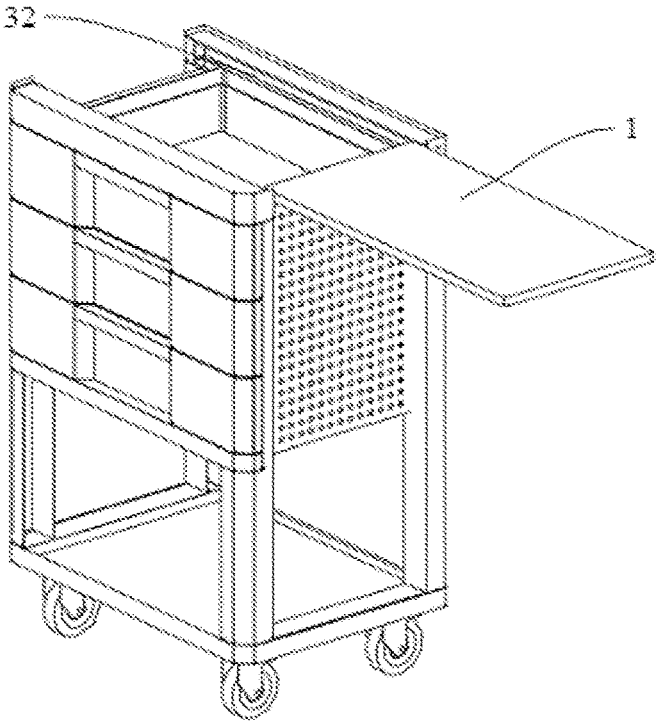
FIG. 10 is a schematic view when a table top slides along sliding grooves according to one embodiment of the present invention.

As illustrated in FIGS. 10 and 11, in another embodiment, sliding grooves 32 are provided in the support 3, sliding groove 32 is provided with a hinging member and the table top 1 may be slid along the sliding grooves 32 and opened and turned over to a state as illustrated in FIG. 7.

In addition, as illustrated in FIG. 1, the edge of the table top 1 is further provided with a raised edge 10 to prevent objects from falling from the worktable. The drawer 5 is further provided with broached grooves to facilitate the opening of the drawer.

The preferred specific embodiments of the present invention have already been described above. It should be understood that one skilled in the art may make various modifications and variations according to the concept of the present invention without contributing any inventive labor. Therefore, all technical solutions which can be obtained by one skilled in the art according to the concept of the present invention on the basis of the prior art through logical analysis, reasoning or limited experiments shall be included in the protective scope determined by the claims.

What is claimed is:

1. A movable worktable, comprising wheels, a support provided on the wheels and a table top provided on the support, wherein the table top can be opened and turned over, a first closed storage space is provided below the table top and an open storage space is provided below the first closed storage space, wherein sliding grooves are provided in the support, one ends of the sliding grooves is provided with hinging members and the table top can be slid along the sliding grooves and opened, turned over around the hinging members, and hung down from one side of the worktable.

2. The movable worktable according to claim 1, wherein a second closed storage space is further provided below the first closed storage space and above the open storage space.

3. The movable worktable according to claim 2, wherein the second closed storage space is a drawer.

4. The movable worktable according to claim 3, wherein a third closed storage space is further provided below the second closed storage space and above the open storage space.

5. The movable worktable according to claim 4, wherein the third closed storage space is a another drawer.

6. The movable worktable according to claim 5, wherein an overall height of the movable worktable is less than or equal to 48 inches.

7. The movable worktable according to claim 6, wherein a height of the open storage space is greater than or equal to 10 inches.

8. The movable worktable according to claim 7, wherein the drawer is provided with a broached groove, a top of the support is provided with a raised edge which is raised above the table top, the wheels are at least two mecanum wheels at a same side, a side of the movable worktable is provided with a hanging plate with meshes or storage grooves, the hinging member is provided with an L-shaped plug pin, an L-shaped plate and a spring, the L-shaped plate is provided with an insertion hole, the spring is disposed over a shaft of the L-shaped plug pin and the L-shaped plug pin is inserted into the L-shaped plate through the insertion hole.

* * * * *